US008371548B1

(12) United States Patent
Bishop

(10) Patent No.: US 8,371,548 B1
(45) Date of Patent: Feb. 12, 2013

(54) HOLDER ATTACHABLE TO A BOAT

(76) Inventor: Jerry W. Bishop, Destin, FL (US)

( * ) Notice: Subject to any disclaimer, the term of this patent is extended or adjusted under 35 U.S.C. 154(b) by 284 days.

(21) Appl. No.: 12/803,949

(22) Filed: Jul. 12, 2010

(51) Int. Cl.
*A47K 1/00* (2006.01)

(52) U.S. Cl. ..... 248/311.2; 224/406; 224/572

(58) Field of Classification Search ..... 248/311.2, 248/310, 682, 690, 691, 692; 224/406, 457, 224/420, 428, 434, 438, 516, 572, 560, 543; 114/345
See application file for complete search history.

(56) References Cited

U.S. PATENT DOCUMENTS

| | | | | | |
|---|---|---|---|---|---|
| 1,925,523 | A | | 9/1933 | Cuff et al. | |
| 1,929,171 | A | * | 10/1933 | Jenkinson | 248/224.7 |
| 2,498,446 | A | * | 2/1950 | Pawsat | 224/421 |
| 2,729,016 | A | | 1/1956 | McDaniel | |
| 2,834,138 | A | | 5/1958 | Pedersen | |
| 2,966,002 | A | | 12/1960 | Hobson et al. | |
| 3,015,467 | A | | 1/1962 | Vieaux | |
| 3,163,338 | A | | 12/1964 | Gottsegen | |
| 3,220,140 | A | | 11/1965 | Shirley, Sr. | |
| 3,627,163 | A | * | 12/1971 | Taylor et al. | 220/6 |
| 3,695,496 | A | * | 10/1972 | Humlong | 224/420 |
| 3,765,632 | A | | 10/1973 | Riggs | |
| 3,775,895 | A | | 12/1973 | Jachim | |
| 4,279,365 | A | | 7/1981 | Hutmacher | |
| 5,092,263 | A | | 3/1992 | Hutchison et al. | |
| 5,165,198 | A | | 11/1992 | Kilian, III | |
| 5,181,621 | A | * | 1/1993 | Plaehn | 211/88.01 |
| 5,419,478 | A | | 5/1995 | Mauro et al. | |
| 6,035,800 | A | | 3/2000 | Clifford | |
| 6,101,966 | A | | 8/2000 | Cumisky | |
| 6,157,756 | A | * | 12/2000 | Ishiwata | 385/31 |
| 6,367,403 | B1 | | 4/2002 | Carter | |
| 6,755,428 | B2 | | 6/2004 | Butler | |
| 7,021,825 | B1 | * | 4/2006 | Schultz | 383/76 |
| 7,066,363 | B2 | | 6/2006 | Lecoq | |
| 7,182,993 | B1 | * | 2/2007 | Hamilton | 428/100 |
| 7,802,709 | B1 | * | 9/2010 | Lewis et al. | 224/560 |
| 2004/0089218 | A1 | | 5/2004 | Cannon, Jr. | |
| 2007/0095998 | A1 | | 5/2007 | Gray | |
| 2009/0189045 | A1 | * | 7/2009 | Peckovich | 248/345.1 |
| 2009/0206098 | A1 | * | 8/2009 | Garahan | 220/737 |
| 2011/0297714 | A1 | * | 12/2011 | Freeman | 224/483 |

* cited by examiner

*Primary Examiner* — Ramon Ramirez
(74) *Attorney, Agent, or Firm* — Peter Loffler

(57) ABSTRACT

A holding device is attachable to a rail, cleat, etc., of a boat or other object such that the holding device holds a cooler or similar objects without using up passenger space. The holding device is a generally rectangular shaped basket member that has a top rail and a first series of straps extending between opposing sides of the rail and a second series of straps extending between opposing ends of the rail, the first straps and the second straps crossing generally normal to one another. One or more straps secure the basket member to an appropriate point on the boat. One or more bumpers buffer the device against the side of the boat. The basket member may have a netting therein to hold small objects safely.

16 Claims, 6 Drawing Sheets

HOLDER ATTACHABLE TO A BOAT

BACKGROUND OF THE INVENTION

1. Field of the Invention

The present invention relates to a holder for ice chests and similar devices wherein the holder overhangs the side of a boat in order to save space on the boat.

2. Background of the Prior Art

Boating is a popular pastime enjoyed by many, especially considering the fact that most Americans live a short driving distance from a navigable body of water. When the weather is agreeable, just load up the boat with fishing gear or other toys, food, drinks, and then launch the boat for a fun filled day on the water. Most boats tend to be relatively small in size. Many factors dictate the need to keep boats relatively small including the costs of the boat, the high gas consumption of a boat, the need to be able to tow the boat to the launch site, and the need to store the boat, among others. While even a small boat can be quite fun and relaxing, certain tradeoffs must be made. With several people on board a relatively small boat, precious little real estate, both deck space and seating space, remains for other items such as bait holders, coolers, picnic baskets, etc, items which are considered essential for all but the shortest of boat rides. Placing such items onto the boat crowds the deck and makes it more difficult for the passengers to move around. While many boats have below deck storage areas, such storage areas are often difficult to access and require the passengers to crowd to one section of the boat, which can be quite uncomfortable, especially when the outside temperatures are very hot.

What is needed is a device that allows boat captains to be able to take coolers and other items aboard a boat without sacrificing the relatively scarce deck space and seating areas aboard the boat. Such a device must allow quick and easy access to the items being held by the device without imposing an undue burden upon the boat's passengers. Ideally such a device should be of relatively simple design and construction and be easy to install, operate, and maintain.

SUMMARY OF THE INVENTION

The holder attachable to a boat of the present invention addresses the aforementioned needs in the art by providing a holder that is capable of holding typical coolers as well as various other items on board a boat without the need to take up any deck or seating real estate of the boat. The holder attachable to a boat allows for quick and easy access to the items being held therein without the need to herd the passengers to a particular section of the boat. The holder attachable to a boat is of relatively simple design and construction so as to be relatively inexpensive to manufacture making the device economically affordable to a large portion of the boat owning consumers. The holder attachable to a boat is relatively easy to install upon the boat, is easy to operate, and to maintain.

The holder attachable to a boat of the present invention is comprised of a generally rectangular-shaped basket member that has a generally rectangular-shaped top rail with a first end and an opposing second end joined by a first side and an opposing second side. A first series of generally U-shaped straps is attached to the first end and attached to the second end, while a second series of generally U-shaped straps is attached to the first side and attached to the second side. At least one securement strap has a third end and a fourth end removably attachable to the third end such that the securement strap encircles the top rail at the first side. A first bumper is attached to at least some of the second series of straps on an outer surface of the basket member below the first side of the top rail or to the top rail. The top rail may be made from a generally rigid material or a generally non-rigid material. The first straps and the second straps may each be made from a generally rigid material or from a generally non-rigid material. A second bumper may be attached to at least some of the second series of straps on an outer surface of the basket member below the first side of the top rail and below the bumper. The first bumper has a first diameter and the second bumper has a second diameter which second diameter is larger than the first diameter. A netting member may be attached to the basket member.

BRIEF DESCRIPTION OF THE DRAWINGS

Similar reference numerals refer to similar parts throughout the several views of the drawings.

DESCRIPTION OF THE PREFERRED EMBODIMENT

Figure 1:
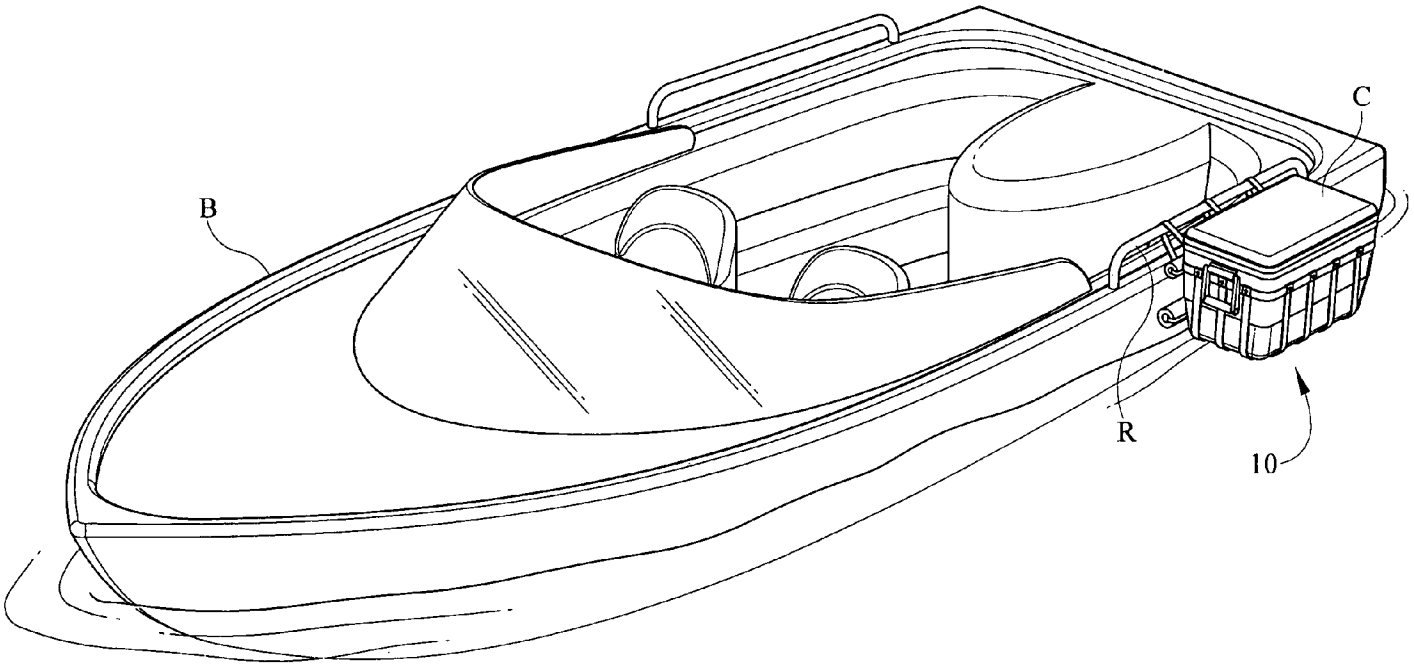
FIG. 1 is a perspective environmental view of the holder attachable to a boat of the present invention.

Referring now to the drawings, it is seen that the holder attachable to a boat of the present invention, generally denoted by reference numeral 10, is comprised of a generally rectangular shaped basket member 12 that has a top rail 14 that has a first end 16 and a second end 18 joined by a first side 20 and a second side 22 with the corners 24 being generally rounded. A first series of generally U-shaped straps 26 extend between the first end 16 and the second end 18 and are attached at each of the respective ends 16 and 18 in any appropriate fashion such as the illustrated rivets 28, stitching, adhesive, etc. Each of the first series of straps 26 has a generally rounded corner 30. Similarly, a second series of generally U-shaped straps 32 extend between the first side 20 and the second side 22 and are attached at each of the respective sides 20 and 22 in similar fashion to the attachment of the first straps 26 to their respective ends 16 and 18. Each of the first second of straps 32 has a generally rounded corner 34. The top rail 14, the first series of straps 26 and the second series of straps 32 are made from an appropriate either rigid (aluminum, hard plastic, etc.,) or not rigid material (leather, Nylon, etc.,) or a combination therefore, such as the top rail 14 being rigid while the first series of straps 26 and the second series of straps being made from a non-rigid material in order to allow the device 10 to be collapsible. If rigid materials are used, it is advantageous to have such materials have an outer layer of an appropriate soft or otherwise-non-abrasive material in or to help prevent scratching any items that may be placed into the device 10 or the item to which the present invention 10 is attached. The first series of straps 26 and the second series of straps 32 may be attached to one another at their respective crossover points, but need not be.

Figure 2:
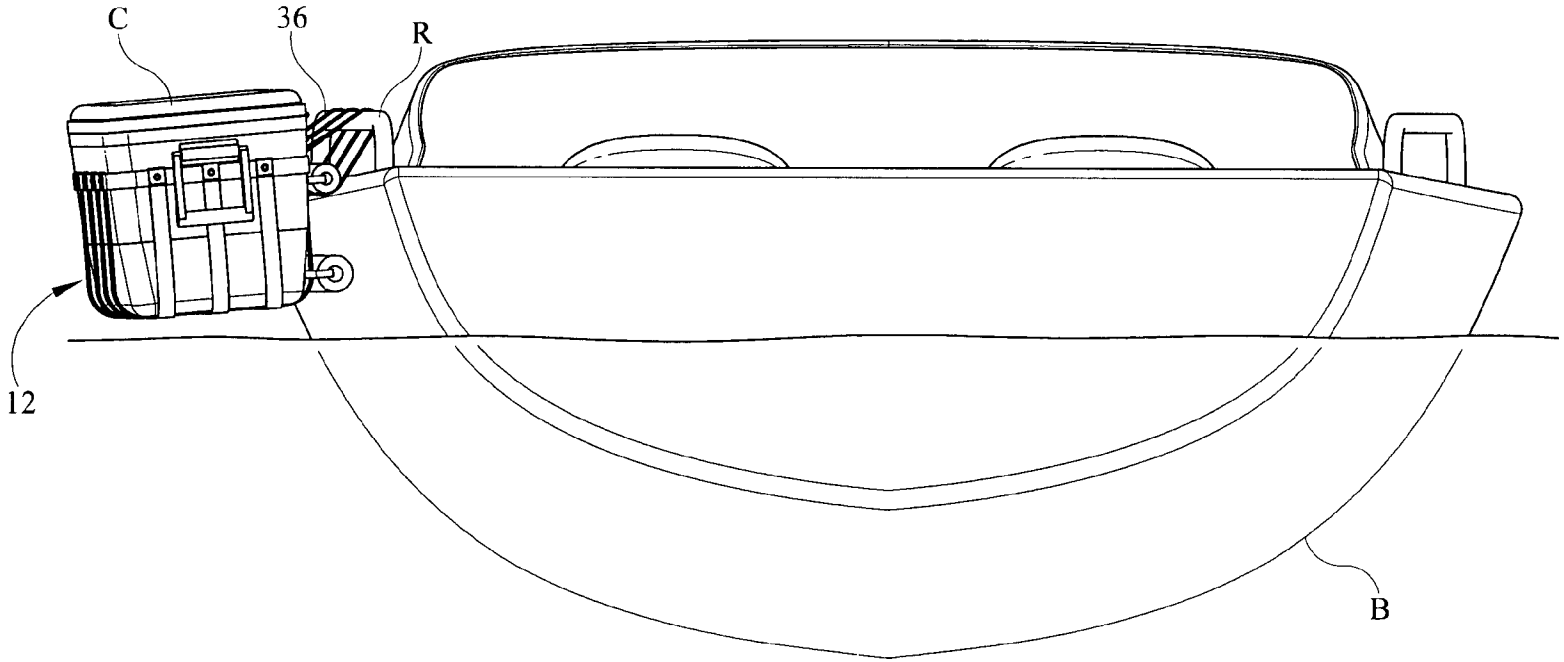
FIG. 2 is a back elevation environmental view of the holder attachable to a boat.
Figure 3:
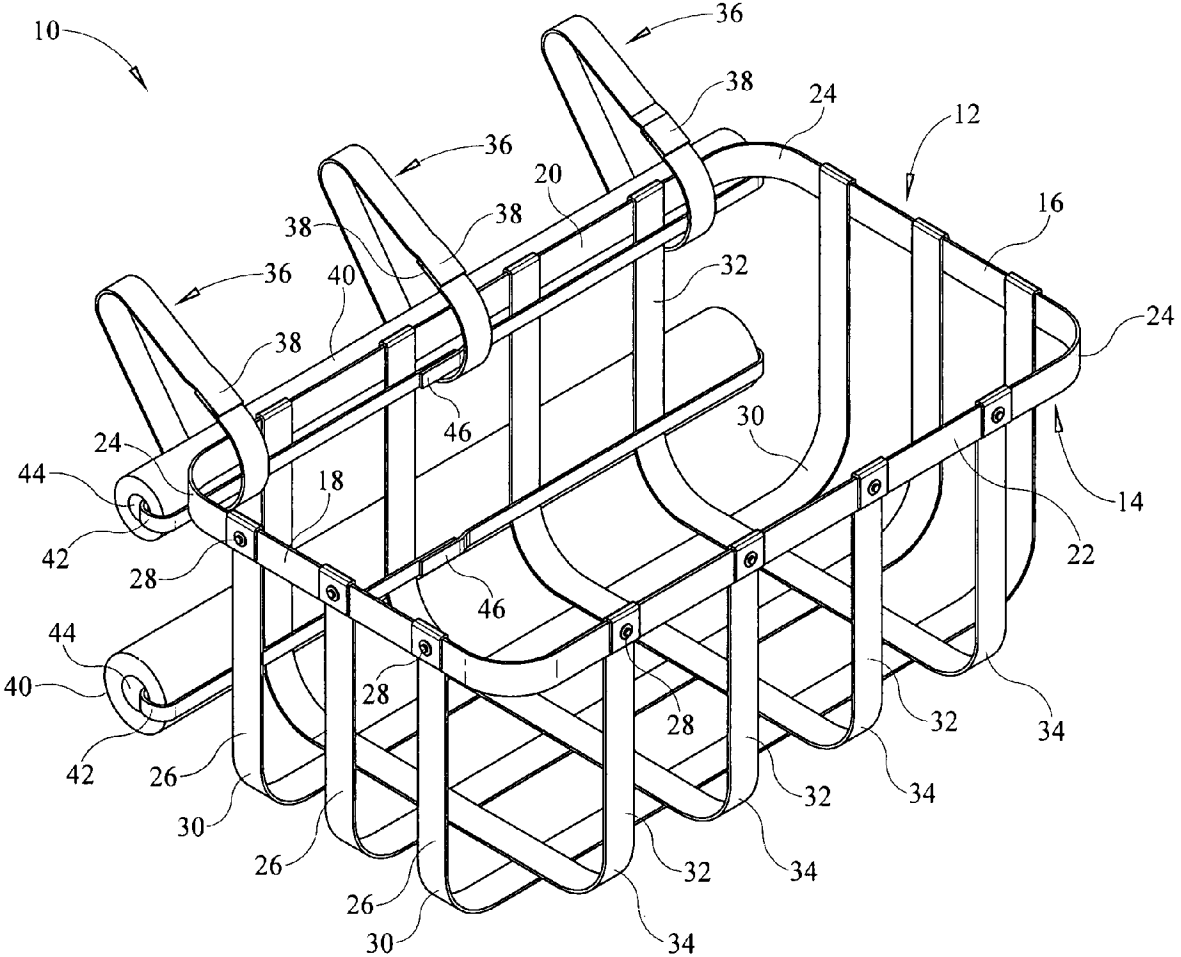
FIG. 3 is a perspective view of the holder attachable to a boat.
Figure 4:
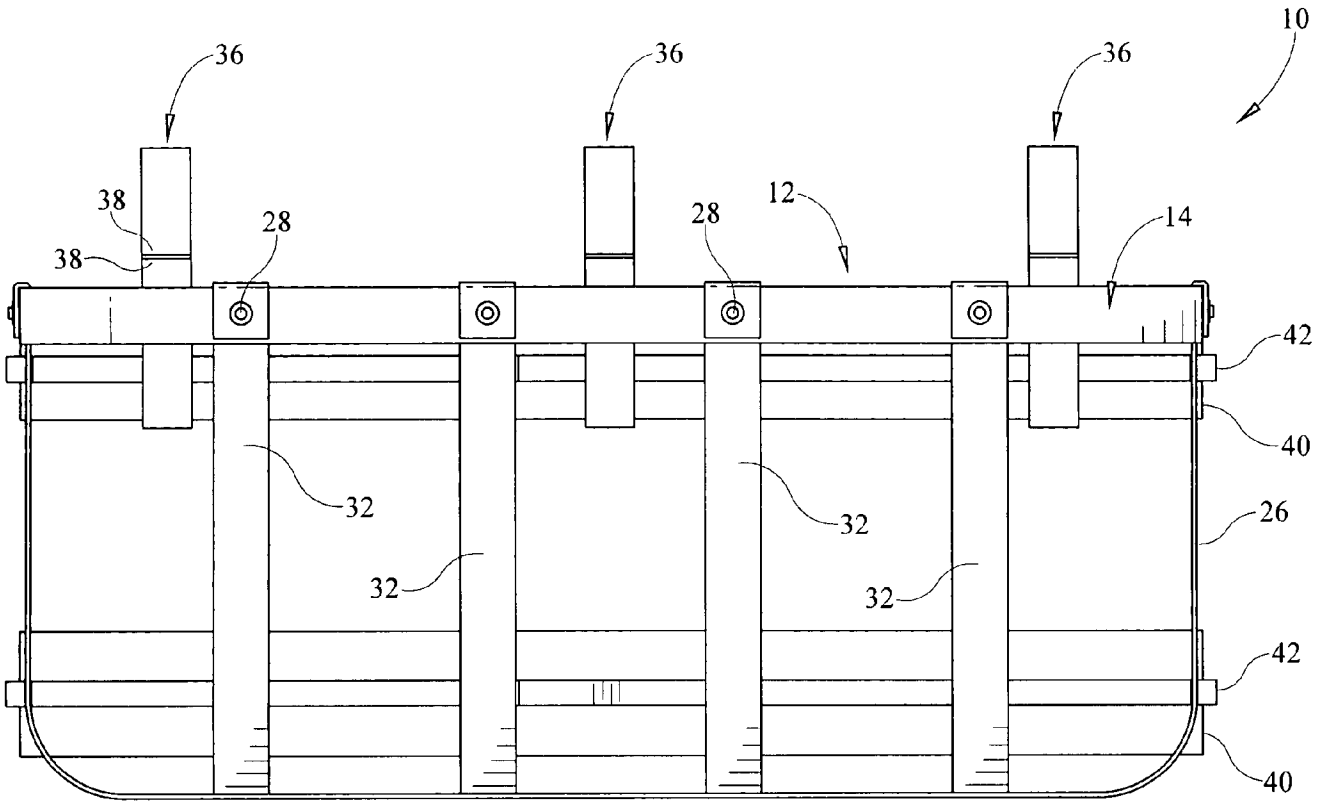
FIG. 4 is a front elevation view of the holder attachable to a boat.
Figure 5:
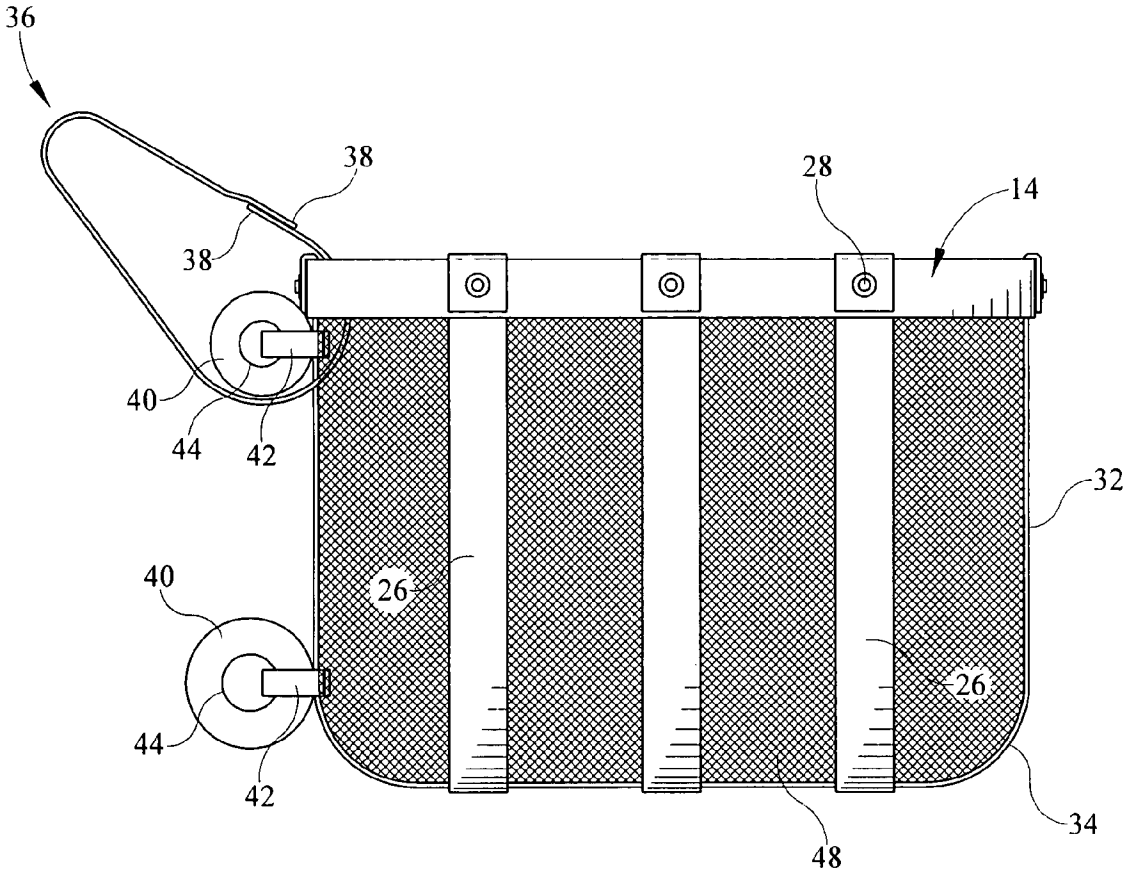
FIG. 5 is a side elevation view of the holder attachable to a boat.
Figure 6:
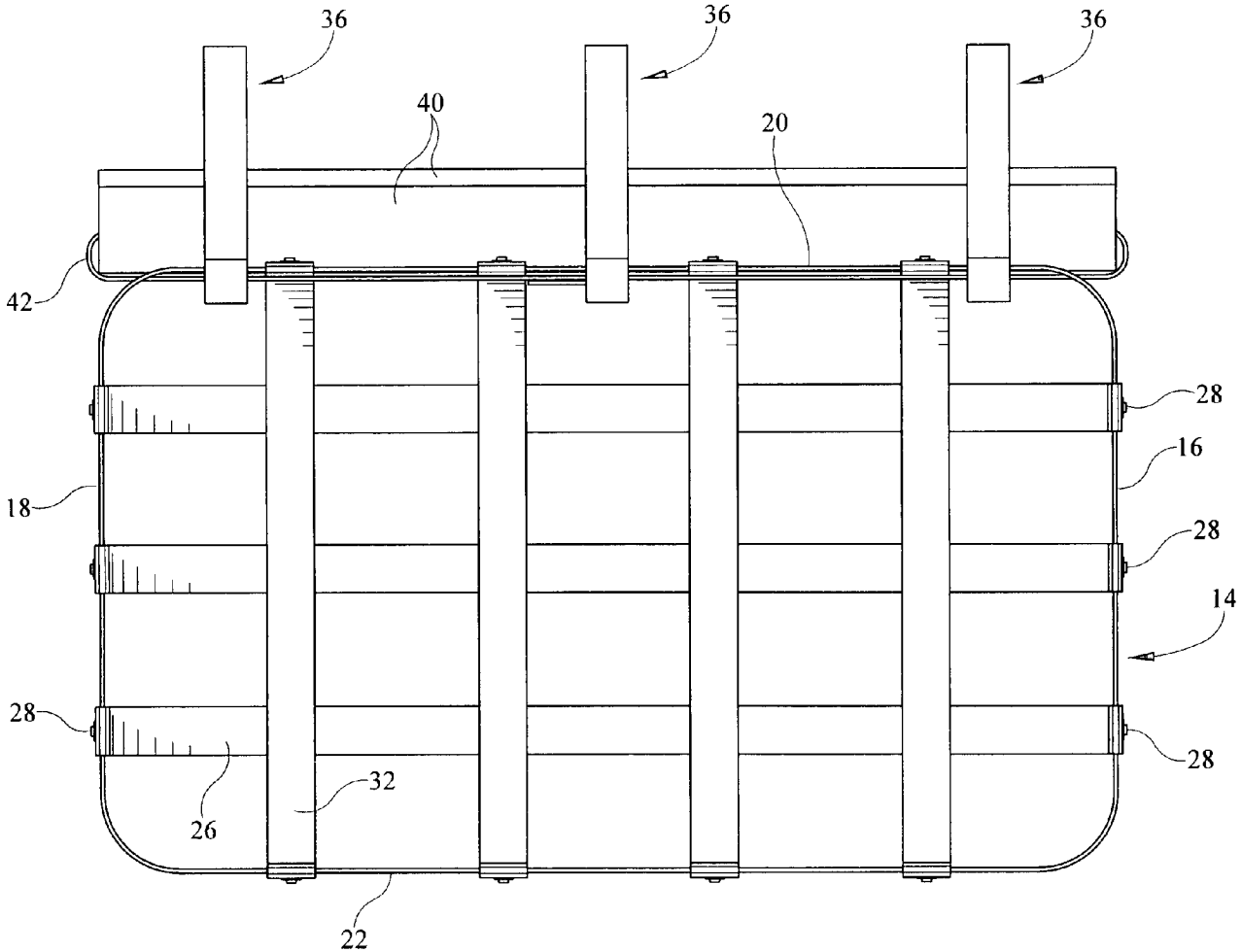
FIG. 6 is a top plan view of the holder attachable to a boat.

As seen, one or more attachment straps 36 encircle the top rail 14 on the first side 20 such that the ends 38 of the straps 36 are capable of being removably attachable (using buckles, cooperating hook and loop material (including the newer hook and dart material), etc.,) to each other in or to allow the basket member 12 to be attached to an appropriate location on a boat B such as to a side rail R as best illustrated in FIGS. 1 and 2, to cleats, etc. Although a single securement strap 36 can be used, for example, a relatively long strap 36 can be secured to the device 10 and to at least two spaced apart cleats, the use of multiple attachment straps 36 allows for a secure and stable attachment of the device 10 to the boat B without worries about weigh capacity. At least one bumper 40, such as the illustrated foam noodle, a rubber bumper, etc., is provided which bumper 40 has a securement strap 42 attached thereto, such as passing through the open center 44 as illustrated, with the securement strap 42 also having ends 46 that are removably attachment to one another in any appropriate fashion and with the securement strap 42 encircling at least some of the second series of straps 22 below the top rail's first side 20 or to the top rail 14 itself. The bumpers 40 help buffer the device 10 and its contents against bumping against the side of the boat B. If more than one bumper 40 is used, then the lowermost bumper 40 may need to have a larger diameter relative to the diameter of the upper bumper in order to account for the curvature of the hull of the boat B. If desired, the uppermost bumper 40 may have a 90 degree edge thereon (not illustrated) in order to allow this bumper 40 to sit on the rub rail of the boat B. The attachment straps 36 and securement straps 42 may be made from the same materials used to make the first straps 26 and the second straps 32.

The inner area of the basket member 12 may have a fine mesh netting 48 therein, either fixedly secured therein or removably secured in appropriate fashion in order to allow relatively small items, such as keys, sunglasses, etc., to be held within the device 10. The netting 48 may be loose fit within the basket member 12 wherein the netting 48 is only attached to the top rail 14 and/or the various ends of the first straps 26 and the second straps 32 or may be form fit wherein the netting 48 is also attached to the straps 26 and 32 along their respective lengths.

In order to use the holder attachable to a boat of the present invention, the bumpers 40 are attached to the second series of straps 22. The attachment straps 36 are used to secure the basket member 12 to a desired point on the boat B (of course the present invention can be attached to items other than boats B). The holder attachable to a boat 10 is now ready for use. A cooler C or similar object can be placed into the basket member 12 and held thereat without impacting the deck or seating areas of the boat B. The bumpers 40 help buffer the cooler's impact against the hull of the boat B even when the boat B is in motion. If used, the mesh 48 allows small objects to be held in addition or instead of the cooler C. When the boating day is complete, the device 10 is removed from the boat B by removing the attachment straps 36 from the point of attachment on the boat B.

While the invention has been particularly shown and described with reference to an embodiment thereof, it will be appreciated by those skilled in the art that various changes in form and detail may be made without departing from the spirit and scope of the invention.

I claim:

1. A holding device comprising:

a basket member that has a generally rectangular-shaped top rail with a first end and an opposing second end joined by a first side and an opposing second side, a first series of generally U-shaped straps attached to the first end and attached to the second end, and a second series of generally U-shaped straps attached to the first side and attached to the second side; and at least one securement strap having a third end and a fourth end removably attachable to the third end, the securement strap completely encircling the top rail at the first side.

2. The holding device as in claim 1 wherein the basket member has a generally rectangular shape.

3. The holding device as in claim 1 wherein the top rail is made from a generally rigid material.

4. The holding device as in claim 3 wherein the first straps and the second straps are each made from a generally rigid material.

5. The holding device as in claim 3 wherein the first straps and the second straps are each made from a generally non-rigid material.

6. The holding device as is in claim 1 further comprising a first bumper that is attached either to at least some of the second series of straps on an outer surface of the basket member below the first side of the top rail or to the top rail.

7. The holding device as is in claim 6 further comprising a second bumper that is attached to at least some of the second series of straps on an outer surface of the basket member below the first side of the top rail and below the first bumper.

8. The holding device as in claim 7 wherein the first noodle has a first diameter and the second noodle has a second diameter which second diameter is larger than the first diameter.

9. The holding device as in claim 1 further comprising a netting member attached to the basket member.

10. A holding device comprising:

a generally rectangular-shaped basket member that has a generally rectangular-shaped top rail with a first end and an opposing second end joined by a first side and an opposing second side, a first series of generally U-shaped straps attached to the first end and attached to the second end, and a second series of generally U-shaped straps attached to the first side and attached to the second side;

at least one securement strap having a third end and a fourth end removably attachable to the third end, the securement strap completely encircling the top rail at the first side; and a first bumper that is attached either to at least some of the second series of straps on an outer surface of the basket member below the first side of the top rail or to the top rail.

11. The holding device as in claim 10 wherein the top rail is made from a generally rigid material.

12. The holding device as in claim 11 wherein the first straps and the second straps are each made from a generally rigid material.

13. The holding device as in claim 11 wherein the first straps and the second straps are each made from a generally non-rigid material.

14. The holding device as is in claim 10 further comprising a second bumper that is attached to at least some of the second series of straps on an outer surface of the basket member below the first side of the top rail and below the first bumper.

15. The holding device as in claim 14 wherein the first bumper has a first diameter and the second bumper has a second diameter which second diameter is larger than the first diameter.

16. The holding device as in claim 10 further comprising a netting member attached to the basket member.

* * * * *